US011673629B1

(12) United States Patent
Rogachenko

(10) Patent No.: US 11,673,629 B1
(45) Date of Patent: Jun. 13, 2023

(54) WATER VESSEL BOARDING LADDER DEVICE AND METHOD OF MANUFACTURE

(71) Applicant: White Water Marine Hardware, Inc., Clearwater, FL (US)

(72) Inventor: Kyle Rogachenko, Yardley, PA (US)

(73) Assignee: White Water Marine Hardware, Inc., Clearwater, FL (US)

( * ) Notice: Subject to any disclaimer, the term of this patent is extended or adjusted under 35 U.S.C. 154(b) by 0 days.

(21) Appl. No.: 17/991,058

(22) Filed: Nov. 21, 2022

(51) Int. Cl.
*B63B 27/14* (2006.01)

(52) U.S. Cl.
CPC ..... *B63B 27/14* (2013.01)

(58) Field of Classification Search
CPC ..... B63B 27/14
See application file for complete search history.

(56) References Cited

U.S. PATENT DOCUMENTS 5,085,165 A * 2/1992 Reed ..... B63B 27/14 14/71.1
6,789,648 B2 9/2004 Cook
6,904,863 B2 6/2005 Mardikian
7,025,174 B1 * 4/2006 Hawley ..... B60R 3/02 182/127
8,075,008 B1 12/2011 Hanser
9,302,719 B1 4/2016 Krishnan
2018/0215304 A1 8/2018 Jevaney

OTHER PUBLICATIONS https://www.nautinox.it/en/shop/ladders-for-boats-and-rib-boats/ladder-2375/ladder-2375/ (2016) retrieved from the internet on Nov. 18, 2022. pp. 1-4.

* cited by examiner

*Primary Examiner* — Stephen P Avila
(74) *Attorney, Agent, or Firm* — Esplin & Associates, PC

(57) ABSTRACT

A water vessel boarding ladder device and method of manufacture are described herein. The boarding ladder device may include one or more of a ladder portion, a handle portion, a coupling portion, and/or other components. The coupling portion may be configured to provide a variable rotational relationship between the handle portion and the ladder portion during simultaneous rotation of the handle portion and the ladder portion.

20 Claims, 6 Drawing Sheets

WATER VESSEL BOARDING LADDER DEVICE AND METHOD OF MANUFACTURE

FIELD OF THE DISCLOSURE

This disclosure relates to water vessel boarding ladders.

BACKGROUND

Water vessels may be boarded by users using a boarding ladder, which may also have built-in handles. A boarding ladder may be integrated into a hull of a vessel, or may be removable.

SUMMARY

Boarding ladders are typically not always maintained in a deployed state on a vessel—meaning they are either deployed when in use, or closed and stowed away when not in use. Storing a boarding ladder may require the ladder to be folded or collapsed, and put in a storage box or other storage location. Vessels having integrated ladders may have storage boxes also integrated into the hull of a vessel where the ladders to be stored in, and deployed from. These types of devices are sometimes referred to as "mailbox" style boarding ladders (e.g., the ladder and/or handles are slide into, and out of, the storage box).

A common user frustration with boarding ladders is the amount of effort required to both deploy the ladder for use, then subsequently close (e.g., collapse and/or fold) the ladder for storage. These frustrations may be attributed to the weight of the boarding ladder and/or the awkward placement of the ladder on a vessel (e.g., on an outer hull), to name a few.

To address these and/or other problems, the present disclosure proposes a water vessel boarding ladder device which utilizes a unique configuration which provides a variable rotational relationship (and consequently torque transfer relationship) between a handle portion and a ladder portion thereof. The handle portion and the ladder portion may rotate simultaneous such that deployment and/or closure may be accomplished through user manipulation of rotating one or the other. The configuration providing the variable rotational relationship may assist a user in both the deployment and closure of the boarding ladder device, to achieve a safe and user friendly utilization thereof. The variability of the rotational relationship may be specially configured to provide a relationship that is suitable for a given position of the boarding ladder device that results in the safe and user-friendly operation.

For example, the handle portion may maintain a rotational advantage (e.g., the handle rotates relatively more than the ladder portion during the simultaneous rotation, or stated otherwise, the ladder portion rotates relatively less than the handle portion during the simultaneous rotation) over a majority of a rotation of the handle portion between the closed position and the deployed position. When rotating from the closed position, however, the handle portion's rotational advantage may decrease through an initial displacement (meaning the amount that the handle portion rotates relatively more than the ladder portion may decrease). Accordingly, as the handle portion is displaced from the closed position, the amount of corresponding displacement of the ladder portion continues to increase through the initial displacement. This may result in overall less effort, and more ease, to deploy from the closed position.

Further, when rotating from the deployed position, the handle portion's rotational advantage may increase through an initial displacement (meaning the amount that the handle portion rotates relatively more than the ladder portion may increase). Accordingly, as the handle portion is displaced from the deployed position, the amount of corresponding displacement of the ladder portion continues to decrease through the initial displacement. This may result in overall more effort to get the boarding ladder device out of the deployed position. However, this may be advantageous in that it may prevent unwanted closure that could otherwise occur from relatively minor displacement of the handle portion. For example, if a user is standing on a rung of the ladder portion and holding the handle portion, it may be undesirable for movement of the handle portion to result in rapid closure of the boarding ladder device.

One or more aspects of the present disclosure relate to a water vessel boarding ladder device comprising one or more of a ladder portion, a handle portion, a coupling portion, and/or other portions. The ladder portion may comprise one or more of a set of side rails, a set of rungs connected between the set of side rails, and/or other components. The handle portion may comprise a set of handles and/or other components. The coupling portion may comprise a set of couplings and/or other components. The set of couplings may connect the handle portion to the ladder portion. By way of non-limiting illustration, an individual coupling in the set of couplings may connect an individual side rail to an individual handle. The coupling portion may define a fixed axis around which the handle portion and the ladder portion simultaneously rotate during deployment and/or closure of the boarding ladder device. By way of non-limiting illustration, the handle portion and the ladder portion may be configured to rotate between a closed position and a deployed position of the boarding ladder device. The connection between the handle portion and the ladder portion provided by the coupling portion may cause the handle portion and the ladder portion to simultaneously rotate in opposite directions during the deployment and/or closure of the boarding ladder device. By way of non-limiting illustration, a rotation of the handle portion in a first direction may cause the ladder portion to rotate in a second direction opposite the first direction during simultaneous rotation.

In some implementations, the coupling portion may be configured to provide a variable rotational relationship between the handle portion and the ladder portion during the simultaneous rotation. The variable rotational relationship may facilitate transfer of rotational displacement from the handle portion to the ladder portion, and vis versa, that varies depending on a current position of the boarding ladder device.

By way of non-limiting illustration, when rotating from the closed position, the handle portion may have a rotational advantage over the ladder portion such that the handle portion may rotate relatively more than the ladder portion. Further, when rotating from the closed position, the rotational advantage may decrease through an initial displacement of the handle portion from the closed position.

By way of non-limiting illustration, when rotating from the deployed position, the handle portion may maintain the rotational advantage over the ladder portion such that the handle portion may rotate relatively more than the ladder portion. Further, when rotating from the deployed position, the rotational advantage may increase through an initial displacement of the handle portion from the deployed position.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a" "an", and "the" include plural referents unless the context clearly dictates otherwise.

DETAILED DESCRIPTION

Figure 1:
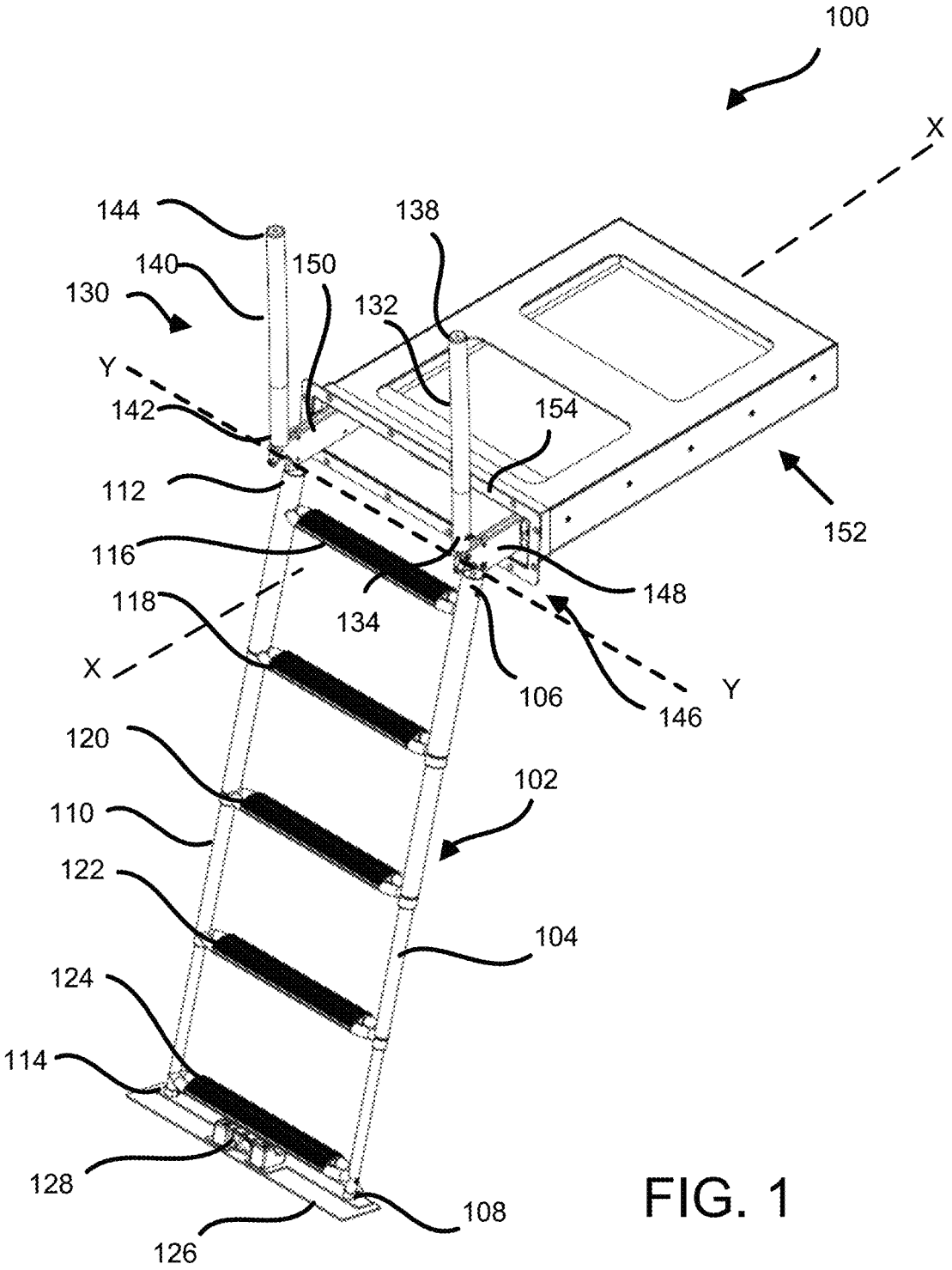
FIG. 1 illustrates a view of a water vessel boarding ladder device in the deployed position, in accordance with one or more implementations.

FIG. 1 illustrates a view of a water vessel boarding ladder device 100, in accordance with one or more implementations. In particular, FIG. 1 shows the boarding ladder device 100 in a deployed position. The boarding ladder device 100 may comprise one or more of a ladder portion 102, a handle portion 130, a coupling portion 146, a storage portion 152, and/or other portions.

The boarding ladder device 100 may be configured to be mounted on a water vessel (not shown in FIG. 1). By way of non-limiting illustration, the boarding ladder device 100 may be configured to be mounted on or through a hull of a vessel. By way of non-limiting illustration, the boarding ladder device 100 may be configured to be mounted at or near a transom of a water vessel (not shown in FIG. 1), and/or other locations. By way of non-limiting illustration, the storage portion 152 of the boarding ladder device 100 may be mounted such that a principle axis "X" of the boarding ladder device 100 may be aligned with a bow-to-stern direction of the vessel, with the boarding ladder device 100 disposed at the stern of the vessel (e.g., at or near a transom). In such an implementation, a user may utilize the boarding ladder device 100 to board a vessel from the stern of the vessel. However, in other implementations, the boarding ladder device 100 may be mounted such that the principle axis X is oriented transversely to the bow-to-stern direction of the vessel such that boarding by a user may be accomplished via port or starboard side of the vessel, depending on where the storage portion 152 is mounted. Various components of the boarding ladder device 100 may be formed from material suitable for the intended purpose. Materials may include, but are not limited to, aluminum, steel, rubber, and/or other materials that are deemed suitable by a person of ordinary skill in the art for the various components described herein.

It is noted that terms such as "posterior", "anterior", "forward", "rearward", "front", "rear", "upper", "lower", "distal", "proximal", "aft," "stern," "starboard," "port," "left", "right," "vertical," and/or "horizontal" may refer herein to conventional directions when considering the device in an as-used position and/or based on the described use of various features. The use of these terms with various components should therefore be easily understood by a person skilled in the art as related to orientation, direction, and/or disposition. Further, some directions may be specifically defined herein and shown in the figures.

In FIG. 1, the ladder portion 102 may comprise one or more of a set of side rails, a set of rungs connected between the set of side rails, a base 126, and/or other components. The set of side rails may include rom side rails. By way of non-limiting illustration, the set of side rails may include one or more of a first side rail 104, a second side rail 110 opposite the first side rail 104, and/or other components. The first side rail 104 may include one or more of a proximal end 106, a distal end 108 opposite the proximal end 106, and/or other features. The second side rail 110 may include one or more of a proximal end 112, a distal end 114 opposite the proximal end 112, and/or other features. The distal ends of the first side rail 104 and second side rail 110 may be coupled to the base 126. The base 126 may generally comprise a rectangular plate that forms a terminating end of the ladder portion 102. The base 126 may further comprise a closure or locking mechanism 128 (e.g., a latch, lock, and/or other devices) that couples the terminating end of the ladder portion 102 to an open end 154 of the storage portion 152 during storage.

The individual side rails in the set of side rails may generally be formed from a tube, or set of telescopically engaged tubes, suitable for the intended purpose. By way of non-limiting illustration, an individual side rail may comprise a set of telescopically engaged segments of stainless steel tubing. In some implementations, an individual segment may be disposed between an individual rung. The telescopic engagement may allow the ladder portion 102 to collapse to a relatively smaller and more compact volume for stowage in a stowed mode (see, e.g., FIG. 3 and FIG. 4). In some implementations, the length of the ladder portion 102 in the deployed mode may be in the range of one to two meters from the respective proximal ends of the side rails to the base 126. In some implementations, the length of the ladder portion 102 in the deployed mode may be about 1.5 meters from the respective proximal ends of the side rails to the base 126. In some implementations, the length of the ladder portion 102 in the deployed mode may be about 1.2 meters from the respective proximal ends of the side rails to the base 126. In some implementations, the length of the ladder portion 102 in the deployed mode may be 1.2 meters from the respective proximal ends of the side rails to the base 126. In some implementations, the length of the ladder portion 102 in a collapsed mode may be in the range of a quarter to one meter from the respective proximal ends of the side rails to the base 126. In some implementations, the length of the ladder portion 102 in a collapsed mode may be about half a meter from the respective proximal ends of the side rails to the base 126. In some implementations, the length of the ladder portion 102 in a collapsed mode may be half a meter from the respective proximal ends of the side rails to the base 126. In some implementations, the term "about" may mean +/−one centimeter, and/or other measures.

The set of rungs may include one or more rungs. By way of non-limiting illustration, the set of rungs may include one or more of a first rung 116, a second rung 118, a third rung 120, a fourth rung 122, a fifth rung 124, and/or other components. It is noted that the quantity of the rungs, spacing of rungs along the set of siderails, and/or width of the rungs, as shown in the figures and described herein are for illustrated purposes only, and not to be considered limiting. Instead, those skilled in the art may appreciate that fewer or more rungs may be utilized, and the spacing between them may be varied, as needed for a particular application the boarding ladder device 100. For example, the size of the vessel on which the boarding ladder device 100 is employed my impact the relative size and/or dimensions of the components of the boarding ladder device 100. In some implementations, the width of the rungs (and therefore spacing between the side rails) may be in the range of one quarter to one half a meter. In some implementations, the width of the rungs (and therefore spacing between the side rails) may be about 0.4 meters. In some implementations, the width of the rungs (and therefore spacing between the side rails) may be 0.4 meters. In some implementations, the width of the rungs (and therefore spacing between the side rails) may be about 0.5 meters. In some implementations, the width of the rungs (and therefore spacing between the side rails) may be 0.5 meters.

The handle portion 130 may comprise a set of handles and/or other components. The set of handles may comprise one or more of a first handle 132, a second handle 140, and/or other components. Individual handles in the set of handles may generally be formed from a tube or bar, made of material suitable for the intended purpose. By way of non-limiting illustration, an individual handle may comprise stainless steel tubing or substantially circular steel bar. It is noted that the quantity and/or length of the individual handles as shown in the figures and described herein are for illustrated purposes only, and are not to be considered limiting. Instead, those skilled in the art may appreciate that fewer or more handles may be utilized, and the spacing between them or length of an individual handle may be varied, as needed for a particular application the boarding ladder device 100. In some implementations, spacing between the handles may be substantially the same as the width of the rungs (and spacing between the side rails).

The first handle 132 may include one or more of a proximal end 134, a distal end 138 opposite the proximal end 134, and/or other features. The second handle 140 may include one or more of a proximal end 142, a distal end 144 opposite the proximal end 142, and/or other features.

The coupling portion 146 may be configured to connect the handle portion 130 to the ladder portion 102. The coupling portion 146 may be configured to connect the handle portion 130 and the ladder portion 102 to the storage portion 152. The coupling portion 146 may comprise a set of couplings and/or other components. The set of couplings may comprise one or more of a first coupling 148, a second coupling 150, and/or other components. The set of couplings may connect respective proximal ends of the handle portion 130 to the ladder portion 102. By way of non-limiting illustration, an individual coupling in the set of couplings may connect an individual side rail to an individual handle at respective proximal ends. For example, the first coupling 148 may connect the first side rail 104 to the first handle 132 at the respective proximal ends 106 and 134; the second coupling 150 may connect the second side rail 110 to the second handle 140 at the respective proximal ends 112 and 142.

In FIG. 1, the coupling portion 146 may define a fixed axis, "Y," around which the handle portion 130 and the ladder portion 102 may simultaneously rotate during deployment and/or closure of the boarding ladder device 100. The axis Y may be orthogonal to principle axis X. By way of non-limiting illustration, the handle portion 130 and the ladder portion 102 may be configured to rotate between a closed position (see, e.g., FIG. 3) and the deployed position (see, e.g., FIG. 1 and/or FIG. 2) of the boarding ladder device 100. The connection between the handle portion 130 and the ladder portion 102 provided by the coupling portion 146 may cause the handle portion 130 and the ladder portion 102 to rotate in opposite directions during the deployment and/or closure of the boarding ladder device 100. By way of non-limiting illustration in FIG. 2, a rotation of the handle portion 130 in a first direction, D1, may cause the ladder portion 102 to rotate in a second direction, D2, opposite the first direction D1 during simultaneous rotation. In other words, when the handle portion 130 rotates downward, the ladder portion 102 may simultaneously rotate upward, and vice versa.

Figure 2:
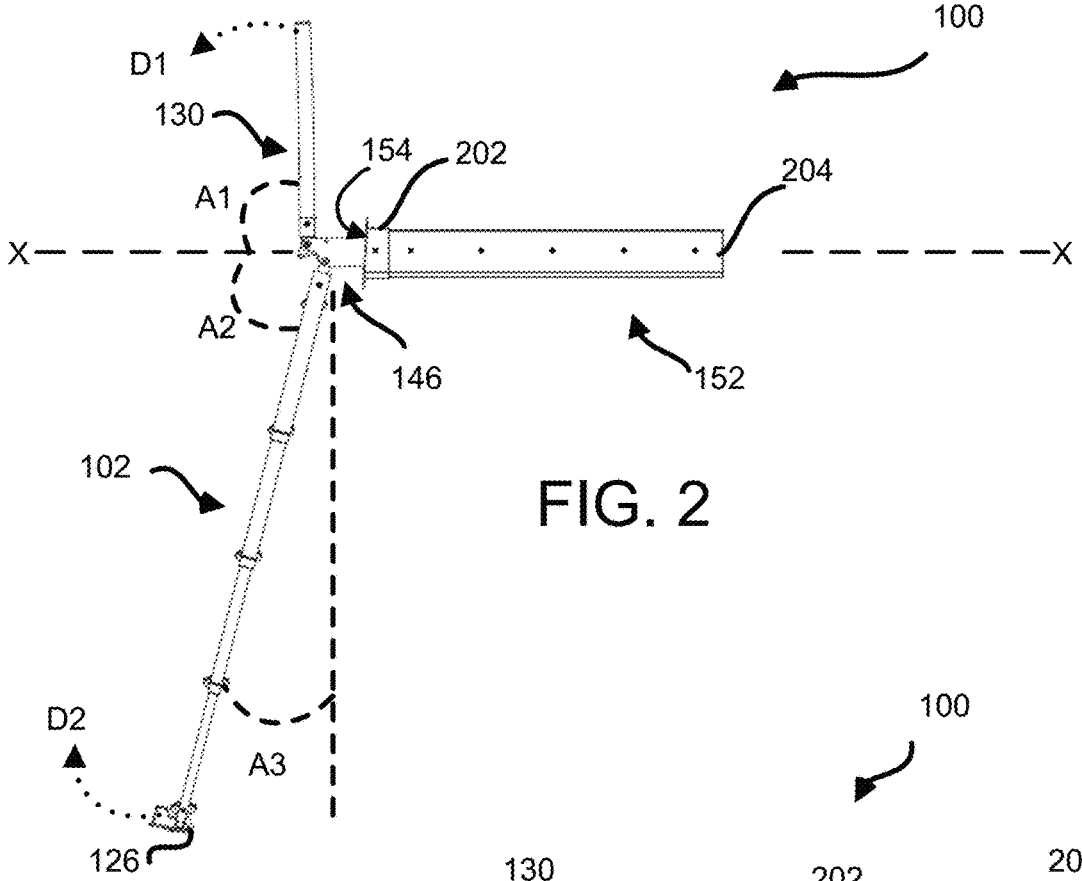
FIG. 2 illustrates a side view of the water vessel boarding ladder device of FIG. 1, in accordance with one or more implementations.
Figure 3:
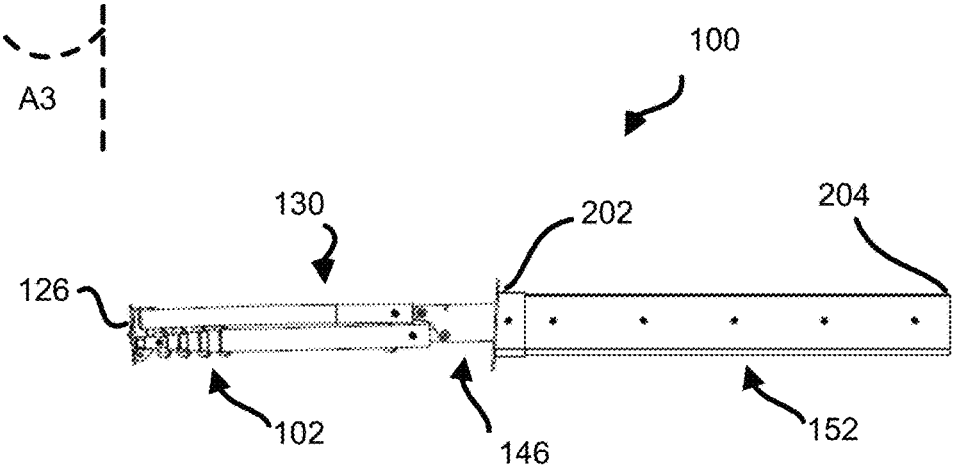
FIG. 3 illustrates a side view of the water vessel boarding ladder device of FIG. 1 in the closed position, in accordance with one or ore implementations.

Referring still to FIG. 2, the deployed position of the handle portion 130 may be achieved through a rotation through angle "A1" relative the closed position (FIG. 3). Angle A1 may be measured from the closed position (FIG. 3), which for the sake of disclosure may be considered horizontal. However, it is noted that during actual utilization of the boarding ladder device 100 the closed position may not be true horizontal given any yaw or pitch of the vessel on water. In some implementations, the angle A1 through which the handle portion 130 rotates between closed and deployed positions may be in the range of eighty five to 100 degrees of rotation. In some implementations, the angle A1 through which the handle portion 130 rotates between closed and deployed positions may be in the range of ninety to 100 degrees of rotation. In some implementations, the angle A1 through which the handle portion 130 rotates between closed and deployed positions may be about ninety five degrees of rotation. In some implementations, the angle A1 through which the handle portion 130 rotates between closed and deployed positions may be ninety four degrees of rotation. In some implementations, the term "about" may mean +/−one degree of rotation.

The deployed position of the ladder portion 102 may be achieved through a rotation through angle "A2" relative the closed position (FIG. 3). In some implementations, the angle A2 through which the ladder portion 102 rotates between closed and deployed positions may be in the range of sixty five to ninety degrees of rotation. In some implementations, the angle A2 through which the ladder portion 102 rotates between closed and deployed positions may be in the range of seventy to eighty degrees of rotation. In some implementations, the angle A2 through which the ladder portion 102 rotates between closed and deployed positions may be about seventy five degrees of rotation. In some implementations, the angle A1 through which the handle portion 130 rotates between closed and deployed positions may be seventy five degrees of rotation. An angle "A3" may denote a deployed position of the ladder portion 102 relative a vertical line (noting it may not be true vertical given a pitch or yaw of a vessel). Angle A3 may be determined by ninety degrees minus A2. By way of non-limiting illustration, with A1 at seventy five degrees, A3 will be fifteen degrees.

Figure 4:
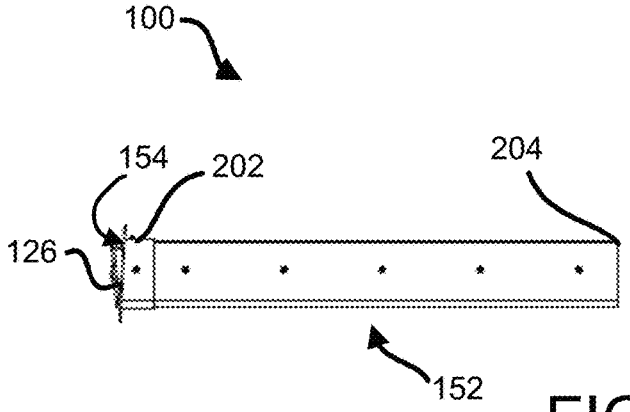
FIG. 4 illustrates a side view of the water vessel boarding ladder device of FIG. 1 in the stowed position, in accordance with one or more implementations.

In FIGS. 2-4, in some implementations, the storage portion 152 may generally comprise a box or container in which the ladder portion 102, handle portion 130, and coupling portion 146 may be stored in a stowed mode of the boarding ladder device 100. The coupling portion 146 may be configured to slidably translate into and out of the storage portion 152. By way of non-limiting illustration, a set of guide rails and/or other components (e.g., rollers, bearings, etc.) may be disposed within the storage portion 152 at each side where there is an individual coupling (not shown in the figures). With the ladder portion 102 and the handle portion 130 in the closed position as in FIG. 3 sliding the coupling portion 146 into the storage portion 152 further draws the ladder portion 102 and the handle portion 130 into an interior volume of the storage portion 152 via an open end 154 at a proximal end 202 of the storage portion 152. The sides of the storage portion 152, other than the open end 154, may be generally closed to define an interior shape and volume suitable for receiving the ladder portion 102 and the handle portion 130 in the closed position. However, cut outs on the sides of the storage portion 152 may be provided for weight reduction purposes. By way of non-limiting illustration, a length of the storage portion 152 from the proximal end 202 to a distal end 204 may be configured to accommodate the length of the ladder portion 102 and the handle portion 130 in the closed position.

FIG. 4 illustrates a stowed mode of the boarding ladder device 100, with the ladder portion 102, handle portion 130, and coupling portion 146 disposed within the storage portion 152. In the stowed mode, the base 126 of the ladder portion 102 may contact the open end 154 of the storage portion 152. The closure or locking mechanism (not shown in FIG. 4) of the base 126 may locally engage the base 126 to the storage portion 152 to safely stow the boarding ladder device 100.

Returning to FIG. 3, in some implementations, the coupling portion 146 may be configured to provide a variable rotational relationship between the handle portion 130 and the ladder portion 102 during the simultaneous rotation. The variable rotational relationship may facilitate variable transfer of rotational displacement (and torque) from the handle portion 130 to the ladder portion 102, and vice versa, that varies depending on a current position of the boarding ladder device 100. As a result, the handle portion 130 to the ladder portion 102 may rotate at different rates depending on a current portion of the boarding ladder device 100.

In some implementations, the variable rotation relationship may be established such that the handle portion 130 may maintain a rotational advantage over a majority of a rotation of the handle portion 130 between the closed position and the deployed position (e.g., majority of the rotation through angle A1 in FIG. 2). A majority may include at least 51% of the rotation between the closed and deployed positions, and/or other measures. However, in some implementations, the handle portion 130 may maintain a rotational advantage over other percentages of the total rotation. By way of non-limiting illustration, in some implementations, the handle portion 130 may maintain a rotational advantage over a minority of total rotation. Minority may include 49% or less of total rotation.

In some implementations, a rotational advantage may mean that the handle portion 130 rotates relatively more than the ladder portion 102 during the simultaneous rotation. That is, a ratio of rotational displacement (e.g., rotational displacement of the handle portion 130 over the rotational displacement of the ladder portion 102) may be greater than one. Stated otherwise, the ladder portion 102 may rotate relatively less than the handle portion 102 during the simultaneous rotate.

In some implementations, when rotating from the closed position (FIG. 3), the handle portion 130 may have the rotational advantage over the ladder portion 102 such that the handle portion 130 rotates relatively more than the ladder portion 130. Further, when rotating from the closed position, the coupling portion 146 may be configured such that the rotational advantage may decrease through an initial displacement of the handle portion 130 from the closed position. This may mean there is an increasing mechanical advantage to ladder portion 102 (e.g., torque output at the ladder portion 102 over torque input at the handle portion 130) through the initial displacement of the handle portion 130 from the closed position. This is because mechanical advantage (e.g., torque output over torque input) may have an inverse relationship to the rotational advantage. A lower mechanical advantage may mean the more the handle portion 130 moves relative the ladder portion 102, the less the torque may be output by the ladder portion 102; while a higher mechanical advantage may mean the less the handle portion 130 moves relative the ladder portion 102, the more the torque may be output by the ladder portion 102. Accordingly, when rotating from closed position, the decrease in rotational advantage of the handle portion 130 may result in the increasing mechanical advantage to the ladder portion 130, such that the simultaneous rotation may become easier for the user pushing or pulling on the handle portion 130 through the initial displacement of the handle portion 130 from the closed position.

In some implementations, the coupling portion 146 may be configured such that the rotational advantage of the handle portion 130 decreases through the initial displacement of the handle portion 130 from the closed position to a point where there is no advantage (e.g., the handle portion 130 and the ladder portion 102 rotate relatively the same), and/or the ladder portion 102 gains the rotational advantage over the handle portion 130. This point may be near an end of the initial displacement of the handle portion 130 from the closed position. In some implementations, "near" may mean +/−5 degrees. The ladder portion 102 may then rotate the same as (and/or relatively more than) the handle portion 130 following the point near the end of the initial displacement of the handle portion 130 from the closed position. The ladder portion 102 rotating the same as, and/or relatively more than, the handle portion 130 may define an intermediate displacement section of the rotational motion of the handle portion 130 between the closed and deployed position.

By way of non-limiting illustration, referring to FIG. 3, the initial displacement of the handle portion 130 from the closed position may be illustrated as an initial portion of angle A1 from the horizontal. In some implementations, the initial displacement may be defined with respect to a percentage of A1. By way of non-limiting illustration, the initial displacement from the closed position may comprise 15% to 25% of initial rotation through A1 from horizontal. By way of non-limiting illustration, the initial displacement may comprise about 20% of initial rotation through A1 from horizontal. In some implementations, the initial displacement may be defined with respect to degrees of rotation. By way of non-limiting illustration, the initial displacement may comprise ten to twenty degrees of initial rotation through A1 from horizontal. By way of non-limiting illustration, the initial displacement may comprise ten degrees of initial rotation through A1 from horizontal. By way of non-limiting illustration, the initial displacement may comprise fifteen degrees of initial rotation through A1 from horizontal.

In some implementations, the intermediate displacement section, which starts at the end of the initial displacement from the closed position, may be defined with respect to a percentage of A1. By way of non-limiting illustration, the intermediate displacement section may comprise 15% to 25% of A1. By way of non-limiting illustration, the intermediate displacement section may comprise about 20% of A1. In some implementations, the intermediate displacement section may be defined with respect to degrees of rotation. By way of non-limiting illustration, the intermediate displacement section may comprise ten to twenty five degrees of rotation following the end of the initial displacement. By way of non-limiting illustration, the intermediate displacement section may comprise fifteen degrees of rotation. By way of non-limiting illustration, the intermediate displacement section may comprise twenty degrees of rotation.

As mentioned previously, the variable rotation relationship may be established such that the handle portion 130 may maintain the rotational advantage over a majority of a rotation of the handle portion 130 between the closed position and the deployed position. This majority may refer to rotational positions that are not within the intermediate displacement section, since that may be the section where they rotate the same as and/or the ladder portion 102 rotates relatively more than handle portion 130. Accordingly, if the intermediate displacement section comprises 15% A1 than the majority would refer to the remaining 85%. Further, if the intermediate displacement section comprises 25% A1 than the "majority" would refer to the remaining 75%, In some implementations, majority may refer to at least 51%.

In some implementations, the coupling portion 146 may be configured such that at a point in the intermediate displacement section, the rotational advantage of the handle portion 130 is again achieved, and continues to be maintained through the remainder of the simultaneous rotation. The point in the intermediate displacement section may comprise a local minima (ambient a maximum for the ladder portion's rotational advantage) and comprise a transition point where rotational advantage is gained back by the handle portion 130.

In FIG. 2, in some implementations, when rotating from the deployed position shown, the handle portion 130 may have the rotational advantage over the ladder portion 102 such that the handle portion 130 rotates relatively more than the ladder portion 130. Further, when rotating from the deployed position, the coupling portion 146 may be configured such that the rotational advantage may increase through an initial displacement of the handle portion 130 from the deployed position. This may mean there is a decreasing mechanical advantage to ladder portion 102 through the initial displacement of the handle portion 130 from the deployed position. Accordingly, with the decreasing mechanical advantage to the ladder portion 130, the simultaneous rotation may become harder for the user pushing or pulling on the handle portion 130 through the initial displacement of the handle portion 130 from the deployed position. However, this may be advantageous in that it may prevent unwanted closure that could otherwise occur from relatively minor displacement of the handle portion. For example, if a user is standing on a rung of the ladder portion and holding the handle portion, it may be undesirable for movement of the handle portion to result in rapid closure of the boarding ladder device. This extra effort to initiate closure of the boarding ladder device 100 may act like a locking mechanisms which more or less locks the boarding ladder device 100 in the deployed position, unless a requisite force is exerted.

In some implementations, the coupling portion 146 may be configured such that the rotational advantage of the handle portion 130 increases through the initial displacement of the handle portion 130 from the deployed position to a point where the rotational advantage is at a local maxima. This point may be near an end of the initial displacement of the handle portion 130 from the deployed position. After the point of local maxima the rotational advantage of the handle portion 130 may decrease. The rotational advantage of the handle portion 130 may decrease from that point through second intermediate displacement section to the point in the intermediate displacement section comprising the local minima, passing through a point where the ladder portion 102 gains the rotational advantage over the handle portion 130, described above.

Thus, after overcoming the "locking" feature enabled by the coupling portion 146 at the deployed position, the configuration may thereafter provide an increase in the mechanical advantage to the ladder portion 102, thereby assisting a user in raising the ladder portion 102 for closure. This may be particularly advantageous if the ladder portion 102 is submerged in water.

By way of non-limiting illustration, referring to FIG. 3, the initial displacement of the handle portion 130 from the deployed position may be illustrated as an initial portion of angle A1 from the vertical. In some implementations, the initial displacement may be defined with respect to a percentage of A1. By way of non-limiting illustration, the initial displacement from the deployed position may comprise 5% to 15% of initial rotation through A1 from vertical. By way of non-limiting illustration, the initial displacement may comprise about 10% of initial rotation through A1 from vertical. In some implementations, the initial displacement from the deployed position may be defined with respect to degrees of rotation. By way of non-limiting illustration, the initial displacement from the deployed position may comprise five to twenty degrees of initial rotation through A1 from vertical. By way of non-limiting illustration, the initial displacement from the deployed position may comprise about fifteen degrees of initial rotation through A1 from vertical. By way of non-limiting illustration, the initial displacement may comprise fifteen degrees of initial rotation through A1 from vertical.

In some implementations, the second intermediate displacement section, which starts at the end of the initial displacement from the deployed position, may be defined with respect to a percentage of A1. By way of non-limiting illustration, the second intermediate displacement section may comprise 35% to 65% of A1. By way of non-limiting illustration, the second intermediate displacement section may comprise about 45% of A1. In some implementations, the second intermediate displacement section may be defined with respect to degrees of rotation. By way of non-limiting illustration, the second intermediate displacement section may comprise twenty to seventy degrees of rotation following the end of the initial displacement from the deployed position. By way of non-limiting illustration, the second intermediate displacement section may comprise about forty five degrees of rotation.

It is noted that while some implementations described herein are in relation to the position of the handle portion 130, this is for illustrative purposes only since it may be common for users to deploy and close by grasping the handled, but are not to be considered limiting. Instead, the same or similar functionality may be achieved in the event that a user may instead apply forces to the ladder portion 102 when deploying or closing the boarding ladder device 100 such that the rotational displacement may be referred to relative the position of the ladder portion 102.

The configuration of the coupling portion 146 providing the variable rotational relationship may assist a user in both the deployment and closure of the boarding ladder device, as well as during rotation therebetween. The variability of the rotational relationship between the handle portion 130 and the ladder portion 102 may be specifically configured to provide a varying relationship that provides improvements in functionality for a given position of the boarding ladder device 100, and/or a relationship that changes at a desired rate from the closed to the deployed positions, that results in safe and user-friendly utilization.

In some implementations, the variable rotational relationship between the handle portion 130 and ladder portion 102 may be defined by a continuum of rotational advantage to the handle portion 102, which may be envisioned as a continuously changing ratio between the amount of rotational displacement of the handle portion 130 ("R1") and the amount of rotational displacement of the ladder portion 102 ("R2"). For illustrative purposes, this rotational displacement ratio can be defined as R1:R2 ("R1 to R2" or "R1 over R2"). It is noted that the torque ratio may be an inverse of the rotational displacement ratio. As mentioned, it is envisioned that the majority of the rotational displacement of the handle portion comprises a situation where R1:R2 is greater than one. Accordingly, the intermediate displacement section may be where R1:R2

In some implementations, at the instant of rotating from the closed position (FIG. 3), the ratio may be in the range of 3:1 to 1.1:1 and/or other ranges. In some implementations, at the instant of rotating from the closed position (FIG. 3), the ratio may be about 1.6:1. "About" may mean +/−0.1. In some implementations, at the instant of rotating from the closed position (FIG. 3), the ratio may be about 1.75:1. In some implementations, at the instant of rotating from the closed position (FIG. 3), the ratio may be about 2.5:1. In some implementations, at the instant of rotating from the closed position (FIG. 3), the ratio may be about 3:1. In some implementations, at the instant of rotating from the closed position (FIG. 3), the ratio may be about 3.5:1.

In some implementations, at the instant of rotating from the deployed position (FIG. 2), the ratio may be in the range of about 2:1 to 1.1:1 and/or other ranges. In some implementations, at the instant of rotating from the deployed position (FIG. 2), the ratio may be about 1.5:1. In some implementations, at the instant of rotating from the deployed position (FIG. 2), the ratio may be about 1.3:1. In some implementations, at the instant of rotating from the deployed position (FIG. 2), the ratio may be 1.4:1.

In some implementations, within the intermediate displacement section, the ratio may be in the range of about 1:1 to 1:1.5 and/or other ranges. In some implementations, at the instant of being at the local minima within the intermediate displacement section, the ratio may be in the range of 1:1.1 to 1:1.3. In some implementations, at the instant of being at the local minima, the ratio may be about 1.1.1.

In some implementations, at the instant of being at the local maxima at the end of the initial displacement from the deployed position, the ratio may be in the range of 1.25:1 to 2:1. In some implementations, at the instant of being at the local maxima, the ratio may be about 1.5:1.

It is noted that while various examples of values and/or ranges are provided herein, this is for illustrative purposes only and is not to be considered limiting Various mechanisms and/or devices may be used to achieve the variable rotational relationship between the handle portion 130 and ladder portion 102, in accordance with one or more implementations presented herein. Such mechanisms and/or devices may be configured to provide variable mechanical advantages, and/or rotational advantages, in accordance with the features and/or functionality described herein.

By way of non-limiting illustration, in some implementations, the coupling portion 149 may be envisioned to employ a cam (or cams) that are sized, shaped, and/or arranged to cause the variable rotational relationship described herein. In some implementations, the coupling portion 146 may be envisioned to employ a series of gears, where different gears are shifted to depending on the position the handle portion 130 and ladder portion 102 to cause the variable rotational relationship described herein. In some implementations, the coupling portion 146 may utilize a linkage configuration to cause the variable rotational relationship described herein. The linkage configuration may include one or more of a four-bar linkage configuration, a five-bar linkage configuration, a six-bar linkage configuration, and/or other configurations. By way of non-limiting illustration, an individual coupling connecting an individual side rail to an individual handle may comprise a four-bar linkage configuration and/or other configuration. For illustrative purposes, a four-bar linkage configuration will now be described as shown in the FIGS. 5-9 which exhibits the features and functionality described herein. However, this is not to imply that the features and/or functionality could not be achieved through other mechanisms.

Figure 5:
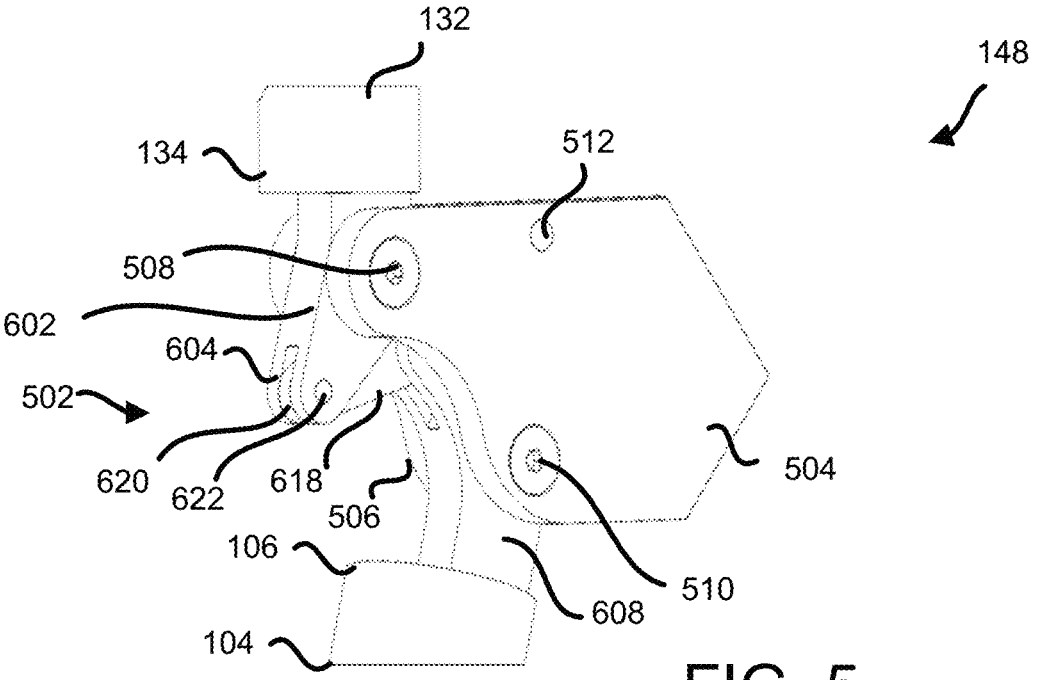
FIG. 5 illustrates a close-up view an individual coupling connecting an individual side rail to an individual handle, in accordance with one or more implementations.

FIG. 5 illustrates a close-up view of the first coupling 148 connecting the first side rail 104 to the first handle 132 at respective proximal ends 106 and 134. The configuration of first coupling 148 may be the same or similar for other individual couplings, such as the second coupling 150 for connecting the second side rail 110 to the second handle 140 (see, e.g., FIG. 1). In some implementations, first coupling 148 may comprise a four-bar linkage configuration 502. The four-bar linkage configuration 502 may include a set of support plates, including support plate 504 and support plate 506, which sandwich additional linkage components therebetween.

Generally, a four-bar linkage may be comprised of one or more of a fixed link (or frame), an input link, coupler link, an output link, and/or other components. The input link may be coupled to the fixed link via a first fixed pivot. The output link may be coupled to the fixed link via a second fixed pivot. The coupler link may be connected between distal ends of the input link and the output link. The connection between the coupler link and the distal end of the input link may define a first moving pivot. The connection between the coupler ink and the distal end of the output link may define a second moving pivot.

The support plates 504 and 506 may provide rigidity and strength to the coupling portion. One or both support plates 504 or 506 may be coupled to a guide rail and/or other components which allow individual couplings to slide into and out of the storage portion (not shown in FIG. 5). The support plates 504 and 506 and/or other portions of first coupling 148 may be formed from material suitable for the intended purpose, such as aluminum, steel, and/or other materials.

The support plates 504 and 506 may define a set of fixed pivots (including first fixed pivot 508 and second fixed pivot 510) which mount the proximal ends 106 and 134 to the support plates 504 and 506. The first fixed pivot 508 and second fixed pivot 510 may be formed by one or more of pins, screws, bolts, and/or other components extending through one or both plates. The support plates 504 and 506 may include a stop element 512. The stop element 512 may be engaged by one of the linkage components of the coupling 502 at the open position to prevent further rotation. The stop element 512 may comprise one or more of a pin, a screw, a bolt, and/or other components.

Figure 6:
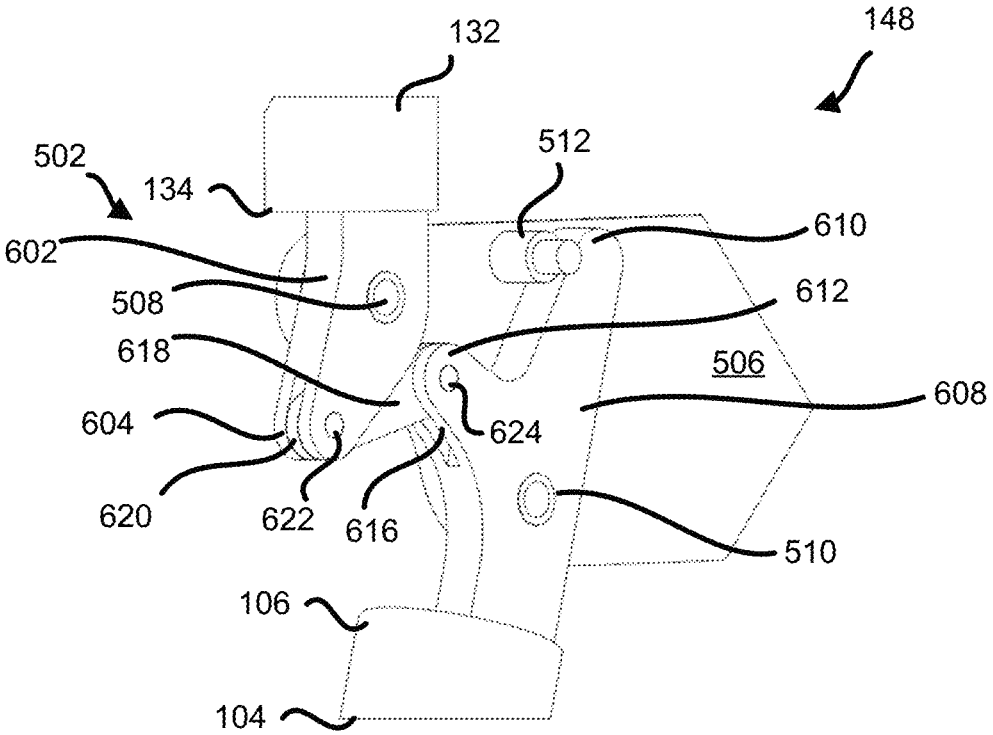
FIG. 6 illustrates the view of the coupling of FIG. 5 with a part removed to show the components of the coupling in the deployed position, in accordance with one or more implementations.

FIG. 6 illustrates the close-up view of the first coupling 148 of FIG. 5, with support plate 504 removed for illustrative purposes so as to show the additional components forming the four-bar linkage configuration 502 more fully.

In some implementations, support plate 506 (and/or plate 504) may define a fixed link, or frame, of the four-bar linkage configuration 502. In particular, the fixed link may be visualized as a line segment between first fixed pivot 508 and second fixed pivot 510. The four-bar linkage configuration 502 may be comprised of one or more of a first tang 602, a second tang 608, a coupler link 618, and/or other components.

In FIG. 6, the proximal end 134 of the first handle 132 may include and/or be integrally coupled to the first tang 602. The first tang 602 may project from the proximal end 134. The first tang 602 may have an aperture (not shown in the figure) through which a pin, screw, or bolt is inserted through to form first fixed pivot 508. A distal end of the first tang 602 may comprise a clevis portion 604. The first tang 602 at the proximal end 134 of the first handle 132 may define an input link of the four-bar configuration. In particular, the input link may be visualized as a line segment between first fixed pivot 508 and a first moving pivot 622 at the clevis portion 604.

The proximal end 106 of the first side rail 104 may include and/or be integrally coupled to the second tang 608, and/or other components. The second tang 608 may bifurcate into a clevis portion 616 and a stopper portion 610. The second tang 608 may be coupled to the support plate 506 via the second fixed pivot 510. The second tang 608 may define an output link of the four-bar configuration. The clevis portion 616 may project from the second tang 608 to form the output link of the second tang 608. In particular, the output link may be visualized as a line segment between fixed pivot 510 and a second moving pivot 624 at the clevis portion 616. The second tang 608 may project from the proximal end 106 along a same line or direction as the first side rail 104. In some implementations, the clevis portion 616 may be disposed at an angle in the range of sixty to eighty degrees relative to the direction of the second tang 608. In some implementations, the clevis portion 616 may be disposed at an angle of about sixty five degrees relative to the direction of the second tang 608. The stopper portion 610 may be formed and arranged to engage the stop element 512 at the open position to prevent further rotation, as shown in FIG. 6.

The coupler link 618 may include a first end 620 connected to the clevis portion 604 of the first tang 602. The connection of the coupler link 618 to the clevis portion 604 of the first tang 602 may define the first moving pivot 622 of the four-bar linkage configuration 502. For example, the coupler link 618 may be attached within the clevis portion 604, and secured via a clevis pin. In some implementations, the coupler link 618 may be in the range of one to six centimeters in length. In some implementations, the coupler link 618 may be in the range of two to five centimeters in length. In some implementations, the coupler link 618 may be in the range of two and a half to three and a half centimeters in length. In some implementations, the coupler link 618 may be about three centimeters in length. In some implementations, "about" may mean +/−one millimeter. In some implementations, the coupler link 618 may be three centimeters in length.

The coupler link 618 may include a second end (not shown in the figure) connected to a distal end 612 of the second tang 608. The distal end 612 of the second tang 608 may be the distal end of the clevis portion 616, as opposed to a distal end of the stopper portion 610. The connection of the coupler link 618 to the distal end 612 of the second tang 608 (e.g., clevis portion 616) may define the second moving pivot 624 of the four-bar linkage configuration 502. For example, the coupler link 618 may be attached within the clevis portion 616 and secured via a clevis pin.

Figure 7:
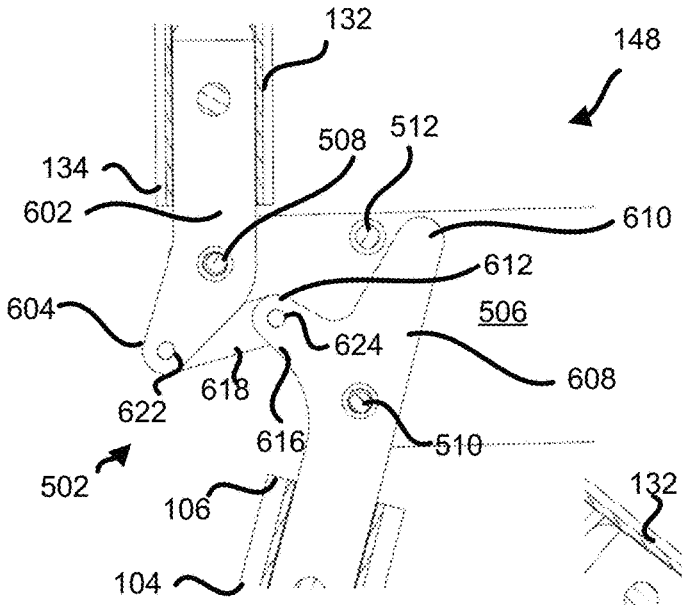
FIG. 7 illustrates a side cross-sectional view of the coupling of FIG. 5 in a deployed position, in accordance with one or more implementations.
Figure 8:
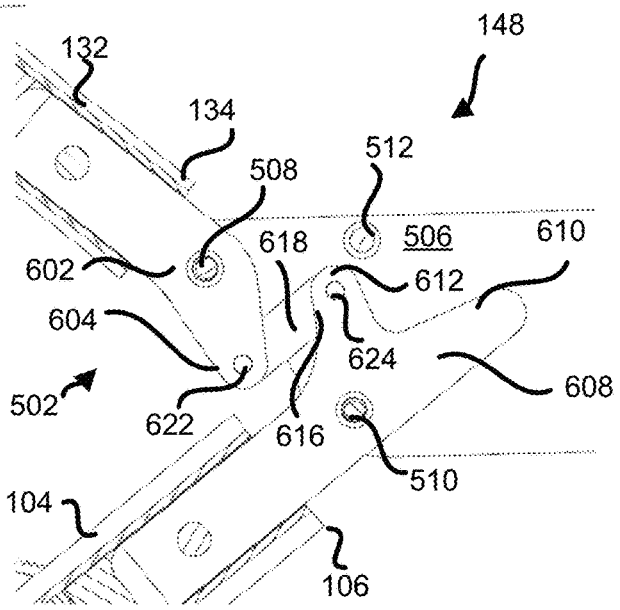
FIG. 8 illustrates a side cross-sectional view of the coupling of FIG. 5 in an intermediate position, in accordance with one or more implementations.
Figure 9:
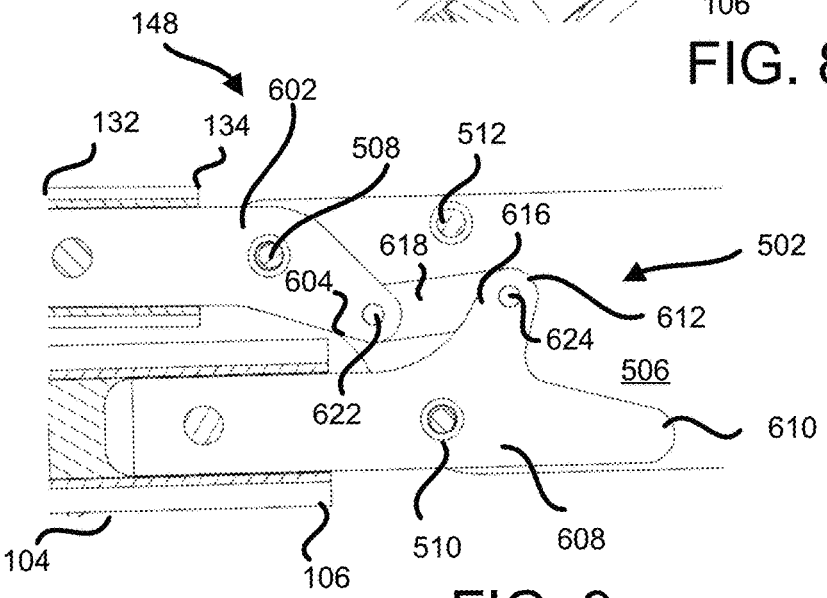
FIG. 9 illustrates a side cross-sectional view of the coupling of FIG. 5 in a closed position, in accordance with one or more implementations.

FIGS. 7-6 illustrate side cross sectional views of the first coupling 148 of FIG. 5 (and FIG. 6), showing the first coupling 148 in various positions. In particular, FIG. 7 illustrates a side cross-sectional view of the first coupling 148 in a deployed position; FIG. 8 illustrates a side cross-sectional view of the first coupling 148 in an intermediate position (e.g., a position that falls within the second intermediate displacement section, described herein); and FIG. 9 illustrates a side cross-sectional view of the first coupling 148 in a closed position, in accordance with one or more implementations. The views may particularly aid in illustrating the configuration of the four-bar linkage and the impact on the variable rotational relationship between the first handle 132 and the first side rail 104, to achieve the features and/or functionality described herein.

FIG. 7 is illustrative of the four-bar linkage confirmation 502 at the instant of rotating from the deployed position (see, e.g. FIG. 2). For example, from this position through an initial displacement of the first handle 132, the first handle 132 may maintain a rotational advantage over the first side rail 104 such that the first handle 132 rotates relatively more than the first side rail 104, and the rotational advantage increases through the initial displacement.

FIG. 9 may be illustrative of the four-bar linkage confirmation 502 at the instant of rotating from the closed position (see, e.g., FIG. 3). For example, from this position through an initial displacement of the first handle 132, the first handle 132 may maintain a rotational advantage over the first side rail 104 such that the first handle 132 rotates relatively more than the first side rail 104, and the rotational advantage decreases through the initial displacement.

FIG. 8 may be illustrative of the four-bar linkage confirmation 502 at the instant of rotating from an intermediate position. In some implementations, this intermediate position may represent halfway through the rotation between the deployed position (FIG. 7) and the closed position (FIG. 9).

This position may fall within the second intermediate displacement section, described herein. If rotation is carried out from this position to the deployed position, the rotational advantage of the first handle 132 over the first side rail 104 may increase until it reaches the local maxima. If rotation is carried out from this position to the closed position, the rotational advantage of the first handle 132 over the first side rail 104 may decrease until it reaches the local minima.

Figure 10:
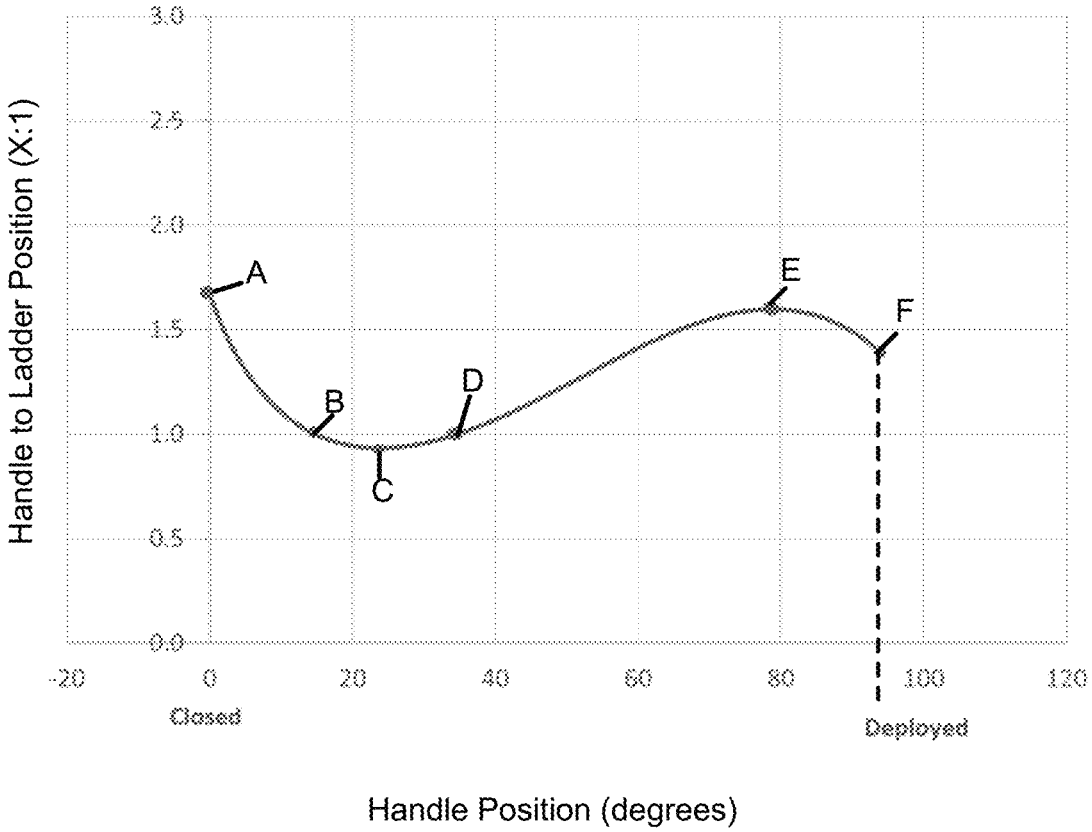
FIG. 10 illustrates a graph of a varying rotational advantage of the handle portion, in accordance with one or more implementations.

FIG. 10 illustrates a graph of a varying rotational advantage of the handle portion, in accordance with one or more implementations. The graph may include a y-axis representing handle portion position to ladder portion position ratio (or R1:R2 described above); and an x-axis representing handle portion position in degrees. The origin (0,0) may represent the closed position (see, e.g., FIG. 3). In some implementations, the rotational advantage, and how it changes based on position as described herein, may be represented by a sinusoid, as shown in the graph. The sinusoid may be comprises of a first end (point "A"), a second end (point "F"), a local minima (point "C"), a local maxima (point "E"), and/or other features. The point A may comprise the rotational advantage provided at the closed position, e.g., about 1.6:1. The point F may comprise the rotational advantage provided at the deployed position, e.g., about 1.4:1. The length of the sinusoid with respect to the x-axis may represent the amount of rotation between the closed and deployed positions, e.g.; about 95 degrees. This length may be representative of angle A1 in FIG. 2. That is, the handle portion may rotate about 95 degrees from the closed position to the deployed position.

The segment A-B may represent the initial displacement of the handle portion from the closed position. As shown, when rotating from the closed position, the rotational advantage decreases through the initial displacement of the handle portion, as illustrated by the downward slope of segment A-B.

The segment B-D may represent the intermediate displacement section where the ladder portion has the rotational advantage and/or there is no advantage. For example, when rotating from the closed position (e.g., going left to right on the page) point B may represent a transition point where the rotational advantage switches from the handle portion to the ladder portion. Conversely, when rotating from the deployed position (e.g., going right to left on the page) point B may represent a transition point where the rotational advantage switches from the ladder portion to the handle portion. When rotating from the closed position (e.g.; going left to right on the page) point D may represent a transition point where the rotational advantage switches from the ladder portion back to the handle portion. Conversely, when rotating from the deployed position (e.g., going right to left on the page) point D may represent a transition point where the rotational advantage switches from the handle portion to the ladder portion. The positions between points B and D may represent positions where the ladder portion may have a slight rotational advantage. The local minima, point C, may occur after the initial displacement of the handle portion from the closed position (A-B) to represent an ending of the decrease of the rotational advantage through the initial displacement of the handle portion from the closed position.

The segment F-E may represent the initial displacement of the handle portion from the deployed position. As shown, when rotating from the deployed position, the rotational advantage increases through the initial displacement of the handle portion, as illustrated by the upward slope of segment F-E. The initial displacement of the handle portion from the deployed position may end at the local maxima; point E.

When rotating from the deployed position, after point E the rotational advantage of the handle portion may decrease, as illustrated by the downward slope of segment E-D. The segment E-D may represent the second intermediate displacement section, where there is a decrease in rotational advantage from point E to the local minima (point C), passing through point D where the ladder portion gains the rotational advantage over the handle portion.

It is noted that the graph shown in FIG. 10 is for illustrative purposes only and not to be considered limiting. Instead, those skilled in the art may appreciate that the coupling portion and/or other features of the boarding ladder device may be modified in order the change the shape of the sinusoid, while achieving one or more of the features and/or functionality described herein. For example, changes made be made such that the sinusoid as a whole may be shifted upward or downwards; the local minima may be shifted (left, right, up, and/or down); then length may be elongated or shortened; the local maxima may be shifted (left, right, up, and/or down); and/or other changes in configuration may be made to impact the sinusoid representation of the rotational advantage.

Figure 11:
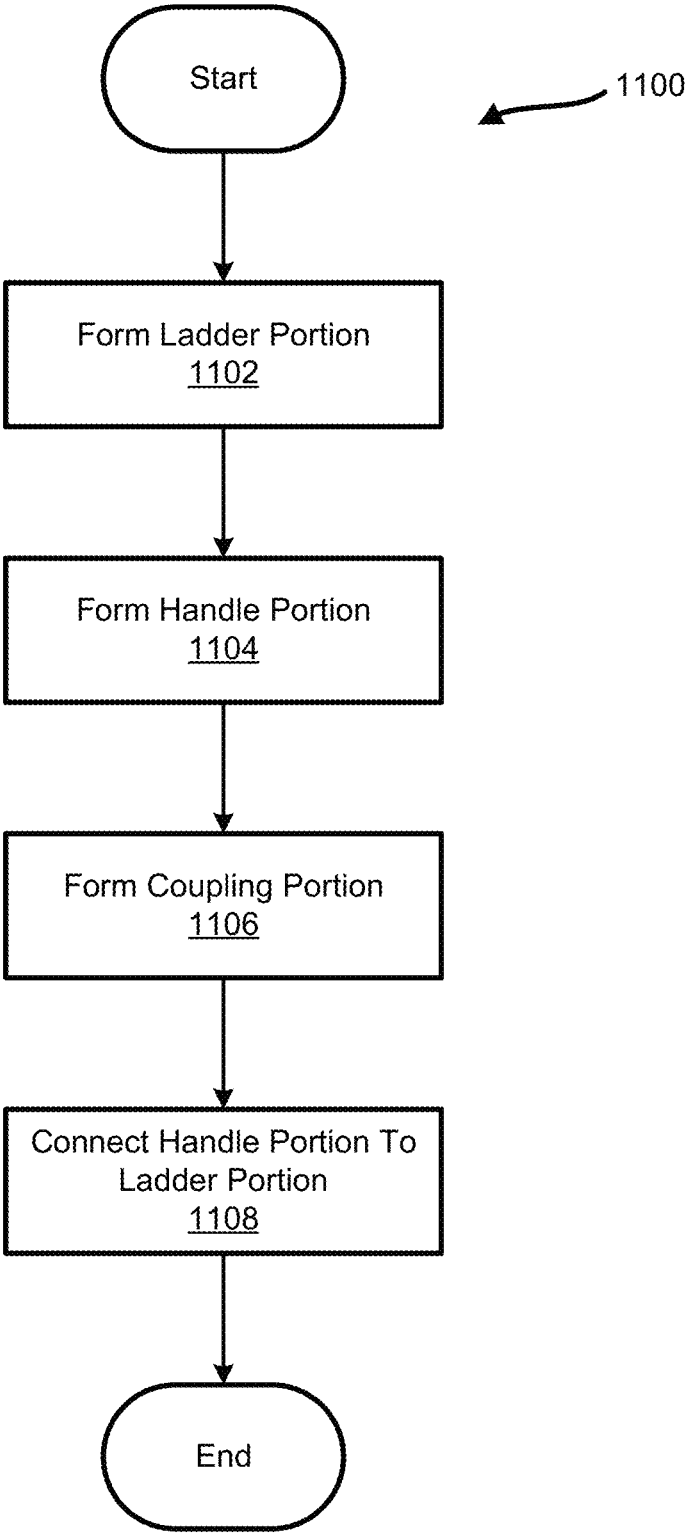
FIG. 11 illustrates a method of manufacture of a water vessel boarding ladder device, in accordance with one or more implementations.

FIG. 11 illustrates a method 1100 of manufacture of a water vessel boarding ladder device, in accordance with one or more implementations. The operations of method 1100 presented below are intended to be illustrative. In some implementations, method 1100 may be accomplished with one or more additional operations not described, and/or without one or more of the operations discussed. Additionally, the order in which the operations of method 1100 are illustrated in FIG. 11 and described below is not intended to be limiting.

In some implementations, method 1100 may be implemented using manual and/or automated manufacturing techniques. A manual manufacturing techniques may include one or more techniques used by skilled artisans in manufacture of boarding ladders made of metal and/or other suitable materials. A technique may include one or more of cutting, riveting, welding, bolting, screwing, drilling, and/or other manual technique. Other techniques known to skilled artisans in boarding ladder manufacture are also within the scope of the present disclosure. An automated manufacturing technique may include machines (e.g., extruders, printers, industrial robots, etc.) and/or one or more processing devices. The one or more processing devices and/or machines may include one or more devices executing some or all of the operations of method 1100 in response to instructions stored electronically on an electronic storage medium. The one or more processing devices and/or machines may include one or more devices configured through hardware, firmware, and/or software to be specifically designed for execution of one or more of the operations of method 1100.

An operation 1102 may include forming a ladder portion comprising a set of side rails, a set of rungs connected between the side rails, and/or other components.

An operation 1104 may include forming a handle portion comprising a set of handles and/or other components.

An operation 1106 may include forming a coupling portion comprising a set of couplings and/or other components.

An operation 1108 may include connecting the handle portion to the ladder portion via the coupling portion. An individual side rail in the set of side rails may be connected to an individual handle in the set of handles via an individual coupling in the set of couplings. The coupling portion may define a fixed axis around which the handle portion and the ladder portion simultaneously rotate. The handle portion and the ladder portion may be configured to rotate between a closed position and a deployed position of the boarding ladder device. The connection between the handle portion and the ladder portion may cause the handle portion and the ladder portion to rotate in opposite directions such that a rotation of the handle portion in a first direction causes the ladder portion to rotate in a second direction opposite the first direction during simultaneous rotation. The coupling portion may be formed to provide a variable rotational relationship between the handle portion and the ladder portion during the simultaneous rotation. By way of non-limiting illustration, when rotating from the closed position, the handle portion may have a rotational advantage over the ladder portion such that the handle portion rotates relatively more than the ladder portion, and the rotational advantage may decrease through an initial displacement of the handle portion from the closed position. By way of non-limiting illustration, when rotating from the deployed position, the handle portion may maintain the rotational advantage over the ladder portion such that the handle portion rotates relatively more than the ladder portion, and the rotational advantage may increase through an initial displacement of the handle portion from the deployed position.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A water vessel boarding ladder device comprising:

a ladder portion comprising a set of side rails and a set of rungs connected between the side rails;

a handle portion comprising a set of handles;

a coupling portion comprising a set of couplings, the set of couplings connecting the handle portion to the ladder portion such that an individual side rail is connected to an individual handle via an individual coupling, the coupling portion defining a fixed axis around which the handle portion and the ladder portion simultaneously rotate, the handle portion and the ladder portion being configured to rotate between a closed position and a deployed position of the boarding ladder device, wherein the connection between the handle portion and the ladder portion causes the handle portion and the ladder portion to rotate in opposite directions such that a rotation of the handle portion in a first direction causes the ladder portion to rotate in a second direction opposite the first direction during simultaneous rotation; and wherein the coupling portion is configured to provide a variable rotational relationship between the handle portion and the ladder portion during the simultaneous rotation, such that:

when rotating from the closed position, the handle portion has a rotational advantage over the ladder portion such that the handle portion rotates relatively more than the ladder portion, and the rotational advantage decreases through an initial displacement of the handle portion from the closed position; and when rotating from the deployed position, the handle portion maintains the rotational advantage over the ladder portion such that the handle portion rotates relatively more than the ladder portion, and the rotational advantage increases through an initial displacement of the handle portion from the deployed position.

2. The boarding ladder device of claim 1, wherein the coupling portion is configured such that the handle portion maintains the rotational advantage over a majority of the rotation of the handle portion between the closed position and the deployed position.

3. The boarding ladder device of claim 2, wherein the coupling portion is configured such that the rotational advantage of the handle portion decreases through the initial displacement of the handle portion from the closed position to a point where the ladder portion gains the rotational advantage over the handle portion, the point being near an end of the initial displacement of the handle portion from the closed position, such that the ladder portion rotates relatively more than the handle portion near the end of the initial displacement of the handle portion from the closed position.

4. The boarding ladder device of claim 1, wherein the coupling portion is further configured such that:

when rotating past the initial displacement of the handle portion from the deployed position, the handle portion maintains the rotational advantage over the ladder portion, and the rotational advantage again decreases through an intermediate displacement section of the handle portion.

5. The boarding ladder device of claim 1, wherein the rotational advantage is represented by a sinusoid, the sinusoid having a local minima and a local maxima, the local minima occurring at an end of the initial displacement of the handle portion from the closed position to represent a decrease of the rotational advantage through the initial displacement of the handle portion from the closed position, and the local maxima occurring at an end of the initial displacement of the handle portion from the deployed position to represent an increase of the rotational advantage through the initial displacement of the handle portion from the deployed position.

6. The boarding ladder device of claim 1, wherein the set of side rails are collapsible to form a stowed mode of the boarding ladder device.

7. The boarding ladder device of claim 1, wherein the individual coupling connecting the individual side rail to the individual handle is a four-bar linkage configuration.

8. The boarding ladder device of claim 7, wherein the four-bar linkage configuration of the individual coupling comprises:

a support plate defining a fixed link;

a first tang at a proximal end of the individual handle defining an input link, the first tang being coupled to the support plate via a first fixed pivot;

a second tang of a proximal end of the individual side rail defining an output link, the second tang being coupled to the support plate via a second fixed pivot; and a coupler link, the coupler link being connected to a first distal end of the first tang defining a first moving pivot, and to a second distal end of the second tang defining a second moving pivot.

9. The boarding ladder device of claim 8, wherein:

the proximal end of the individual side rail further includes a stopper portion, the second tang and the stopper portion forming a bifurcated end of the individual side rail;

the support plate further includes a stop element; and the stopper portion is formed and arranged to engage the stop element at the deployed position to prevent further rotation.

10. The boarding ladder device of claim 1, further comprising:

a storage box, wherein the coupling portion is configured to slidably translate into and out of the storage box via a set of guide rails.

11. A method of manufacture of a water vessel boarding ladder device, the method comprising:

forming a ladder portion comprising a set of side rails and a set of rungs connected between the side rails;

forming a handle portion comprising a set of handles;

forming a coupling portion comprising a set of couplings, connecting the handle portion to the ladder portion using the set of couplings such that an individual side rail is connected to an individual handle via an individual coupling, the coupling portion defining a fixed axis around which the handle portion and the ladder portion simultaneously rotate, the handle portion and the ladder portion being configured to rotate between a closed position and a deployed position of the boarding ladder device, wherein the connection between the handle portion and the ladder portion causes the handle portion and the ladder portion to rotate in opposite directions such that a rotation of the handle portion in a first direction causes the ladder portion to rotate in a second direction opposite the first direction during simultaneous rotation; and wherein the coupling portion is formed to provide a variable rotational relationship between the handle portion and the ladder portion during the simultaneous rotation, such that:

when rotating from the closed position, the handle portion has a rotational advantage over the ladder portion such that the handle portion rotates relatively more than the ladder portion, and the rotational advantage decreases through an initial displacement of the handle portion from the closed position; and when rotating from the deployed position, the handle portion maintains the rotational advantage over the ladder portion such that the handle portion rotates relatively more than the ladder portion, and the rotational advantage increases through an initial displacement of the handle portion from the deployed position.

12. The method of claim 11, wherein the coupling portion is formed such that the handle portion maintains the rotational advantage over a majority of the rotation of the handle portion between the closed position and the deployed position.

13. The method of claim 12, wherein the coupling portion is formed such that the rotational advantage of the handle portion decreases through the initial displacement of the handle portion from the closed position to a point where the ladder portion gains the rotational advantage over the handle portion, the point being near an end of the initial displacement of the handle portion from the closed position, such that the ladder portion rotates relatively more than the handle portion near the end of the initial displacement of the handle portion from the closed position.

14. The method of claim 11, wherein the coupling portion is formed such that when rotating past the initial displacement of the handle portion from the deployed position, the handle portion maintains the rotational advantage over the ladder portion, and the rotational advantage again decreases through an intermediate displacement section of the handle portion.

15. The method of claim 11, wherein the rotational advantage is represented by a sinusoid, the sinusoid having a local minima and a local maxima, the local minima occurring at an end of the initial displacement of the handle portion from the closed position to represent a decrease of the rotational advantage through the initial displacement of the handle portion from the closed position, and the local maxima occurring at an end of the initial displacement of the handle portion from the deployed position to represent an increase of the rotational advantage through the initial displacement of the handle portion from the deployed position.

16. The method of claim 11, wherein the set of side rails are collapsible to form a stowed mode of the boarding ladder device.

17. The method of claim 11, wherein the individual coupling connecting the individual side rail to the individual handle is a four-bar linkage configuration.

18. The method of claim 17, wherein the four-bar linkage configuration of the individual coupling is formed by:

forming a support plate defining a fixed link;

forming a first tang at a proximal end of the individual handle defining an input link;

coupling the first tang to the support plate to define a first fixed pivot;

forming a second tang of a proximal end of the individual side rail defining an output link;

coupling the second tang to the support plate to define a second fixed pivot;

forming a coupler link; and connecting the coupler link to a first distal end of the first tang defining a first moving pivot, and to a second distal end of the second tang defining a second moving pivot.

19. The method of claim 18, further comprising:

forming a stopper portion at the proximal end of the individual side rail, the second tang and the stopper portion forming a bifurcated end of the individual side rail;

forming a stop element on the support plate such that the stopper portion engages the stop element at the deployed position to prevent further rotation.

20. The method of claim 11, further comprising:

forming a storage box including a set of guide rails; and attaching the coupling portion to the storage box such that the coupling portion slidably translates into and out of the storage box via the set of guide rails.

* * * * *